US006595289B2

(12) United States Patent
Tumlin et al.

(10) Patent No.: US 6,595,289 B2
(45) Date of Patent: Jul. 22, 2003

(54) METHOD AND APPARATUS FOR PLUGGING A WELLBORE

(75) Inventors: David Moore Tumlin, Breaux Bridge, LA (US); Gene K. Fugatt, Sr., Lafayette, LA (US); David Hosie, Sugerland, TX (US); Mike Luke, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 68 days.

(21) Appl. No.: 09/849,043

(22) Filed: May 4, 2001

(65) Prior Publication Data

US 2002/0162657 A1 Nov. 7, 2002

(51) Int. Cl.[7] ..... E21B 33/138; E21B 43/14

(52) U.S. Cl. ..... 166/286; 166/297; 166/55.1; 166/177.4; 175/4.52

(58) Field of Search ..... 166/285, 286, 166/297, 298, 55, 55.1, 55.7, 177.4; 175/4.5, 4.56, 4.54, 451, 4.52

(56) References Cited

U.S. PATENT DOCUMENTS

| | | | | | |
|---|---|---|---|---|---|
| 3,414,071 | A | | 12/1968 | Alberts | 175/4.51 |
| 3,415,321 | A | | 12/1968 | Venghiattis | 166/35 |
| 3,831,677 | A | * | 8/1974 | Mullins | 166/128 |
| 4,050,529 | A | | 9/1977 | Tagirov et al. | 175/422 |
| 4,158,388 | A | * | 6/1979 | Owen et al. | 166/100 |
| 4,275,788 | A | * | 6/1981 | Sweatman | 166/285 |
| 4,349,071 | A | | 9/1982 | Fish | 166/124 |
| 4,531,583 | A | * | 7/1985 | Revett | 166/277 |
| 4,679,624 | A | * | 7/1987 | Harris et al. | 166/120 |
| 4,687,063 | A | | 8/1987 | Gilbert | 166/382 |
| 4,688,640 | A | * | 8/1987 | Pritchard, Jr. | 166/297 |
| 4,708,202 | A | * | 11/1987 | Sukup et al. | 166/122 |
| 5,111,885 | A | | 5/1992 | Umphries | 166/297 |
| 5,191,932 | A | | 3/1993 | Seefried et al. | 166/291 |
| 5,295,544 | A | | 3/1994 | Umphries | 166/297 |
| 5,423,387 | A | * | 6/1995 | Lynde | 175/61 |
| 5,472,052 | A | * | 12/1995 | Head | 166/298 |
| 5,507,345 | A | * | 4/1996 | Wehunt et al. | 166/285 |

FOREIGN PATENT DOCUMENTS

| | | | |
|---|---|---|---|
| EP | 0 962 624 | 12/1999 | E21B/43/112 |

OTHER PUBLICATIONS

PCT Partial International Search Report from International Application No. PCT/GB02/02012, Dated Aug. 05, 2002.

* cited by examiner

*Primary Examiner*—David Bagnell
*Assistant Examiner*—Jennifer H. Gay
(74) *Attorney, Agent, or Firm*—Moser, Patterson & Sheridan, L.L.P.

(57) ABSTRACT

The present invention provides a method and apparatus for plugging a wellbore in a trip saving manner. In one aspect, the invention includes a cement retainer disposed on a run-in string and a radially expanded perforating assembly disposed below the cement retainer. In a single run, the apparatus provides for perforating a wellbore and squeezing cement through the perforations and into the formation therearound. In another aspect, a method of plugging the wellbore includes running a cement retainer and a radially expanded perforating assembly into a wellbore on a run-in string. After the cement retainer is set, a firing head is actuated to cause the perforating gun to discharge. After perforations are formed, cement is introduced from the cement retainer into the isolated area and squeezed through the perforations. Thereafter, the run-in string disengages from the cement retainer leaving behind the plug formed. In yet another aspect, a firing head capable of being actuated by different means is used to discharge the perforating assembly.

27 Claims, 7 Drawing Sheets

METHOD AND APPARATUS FOR PLUGGING A WELLBORE

BACKGROUND OF THE INVENTION

1. Field of the Invention

The present invention relates to methods and apparatus for plugging a wellbore. More particularly, the invention relates to methods and apparatus to squeeze cement through perforated casing to plug a wellbore. More particularly still, the invention relates to the perforation of casing and the squeezing of cement in a single trip. The invention further relates to a firing head capable of being actuated by different means.

2. Background of the Related Art

In the oil and gas industry, plugging operations are often performed to seal wellbores in order to abandon the wells. These "plug and abandonment" techniques are required under various state and federal laws and regulations. Plug and abandonment operations performed upon a cased wellbore require that at least a section of the wellbore be filled with cement to prevent the upward movement of fluids towards the surface of the well. To seal the wellbore, a bridge plug is typically placed at a predetermined depth in the wellbore and thereafter, cement is injected into the wellbore to form a column of cement high enough to ensure the wellbore is permanently plugged.

In addition to simply sealing the interior of a wellbore, plug and abandonment regulations additionally require that an area outside of the wellbore be sufficiently blocked to prevent any fluids from migrating towards the surface of the well along the outside of the casing. Migration of fluid outside the casing is more likely to arise after a fluid path inside the wellbore has been blocked. Additionally, where multiple strings of casing are line a wellbore, the annular area between the concentric strings can form a fluid path in spite of being cemented into place when the well was completed. Bad cement jobs and weakening conditions of cement over time can lead to paths being opened in the cement adequate for the passage of fluid.

In order to ensure the area outside of the wellbore is adequately blocked, cement is typically "squeezed" through perforations into the formation surrounding the wellbore. By pumping cement in a non-circulating system, a predetermined amount of cement may be forced into the earth and can thereafter cure to form a fluid barrier.

The perforations utilized in a cement squeeze operation are typically formed for squeezing cement. Perforations are formed with a perforating assembly that includes a number of shaped charges designed to penetrate the casing wall and extend into a formation therearound. Recently, advances in perforating have led to the development of perforating apparatus including biased members that remain in contact with the casing wall as the apparatus is lowered into the wellbore and ensure that the shaped charges remain at a predetermined distance from the wall of the wellbore. Perforating guns that are expanded and biased against the casing wall are more advantageous for making exact perforations. An example of an expanded perforating gun is described in U.S. Pat. No. 5,295,544 to Umphries, assigned to the same entity as the present invention and incorporated by reference herein in its entirety. The perforating gun includes wear plates that slide along the inner diameter of the casing and are biased against the inner wall of the well pipe casing. A string of charges are spaced about the periphery of the perforating gun. The force of the perforation is controlled by varying the standoff distance of the explosive charge from the casing wall. By controlling the spacing, it is possible to penetrate only an inner string of casing without penetrating an outer string. Furthermore, the charges can uniformly perforate all around the casing.

In a conventional plug and abandonment operation, a bridge plug or cement plug is first run into the wellbore and set therein, typically by mechanical means whereby some sealing element extends radially outward to seal the annular area formed between the outside of the device and the casing wall. Thereafter, a perforating gun is lowered into the wellbore to a pre-determined depth and discharged to perforate the casing. The perforating gun is typically discharged by a firing head. The firing head used may be pressure actuated firing heads or mechanically actuated firing heads. After the perforations are made, the perforating gun may be retrieved. Thereafter, a cement retainer is lowered into the wellbore and set above the bridge plug. The cement retainer, like the bridge plug, acts as a packer to seal an annulus between the body of the cement retainer and the casing and isolate the area where the casing will be perforated. Cement is then supplied into the cement retainer through a run-in string of tubulars attached thereto. Utilizing pressure, cement fills the isolated area of the wellbore and also extends through the perforations into the surrounding areas in the formation. After the cement is squeezed, the run-in string is disengaged from the cement retainer. Cement is then typically deposited on the cement retainer as a final plug.

In some instances, the wellbore to be plugged and abandoned has an outer string of casing and an inner string of casing coaxially disposed therein. In these instances, an annular space between the concentric strings must be squeezed with cement to prevent the subsequent migration of fluid towards the surface of the well. The plugging operation is similar to above except that only the inner string is perforated and the cement is squeezed into the annular space between the strings.

Plug and abandon operations are also performed on a central wellbore prior to the formation of a lateral wellbore. In these cases, the lateral wellbore may be drilled from a platform that includes a cement plug remaining in the central wellbore after it has been plugged. Lateral wellbores are typically formed by placing a whipstock or some other diverter in a central wellbore adjacent a location where the lateral wellbore is to be formed. The whipstock is anchored in place and thereafter, a rotating mill disposed on drill string is urged into the casing wall to form a window therein. After the window is formed, a conventional drill bit extends out into the formation to form a borehole, which can subsequently be lined with a tubular.

There are problems with the plug and abandonment techniques described above. The biggest problem relates to the number of trips into the wellbore required to adequately complete a plug and abandonment job. Another problem relates to the poor quality of perforations that are made in casing using conventional perforating apparatus. Another problem still, relates to failed firing heads on perforating guns.

Since the conventional perforating assembly has only one firing head attached, failure of the firing head to actuate can mean significant increases in costs and delays. For example, when the firing head does not actuate and ignite the perforating charges, the perforating assembly must be retrieved and the firing head replaced. Consequently, an extra run into the wellbore is necessitated by the failure. One solution is to attach two firing heads, each requiring a different type of actuation, to the perforating assembly so one may act as a backup. For instance, when a drop bar fails to acquire sufficient energy to actuate a mechanically actuated firing head, the wellbore may be pressurized to actuate the backup pressure actuated firing head and discharge the perforating assembly without retrieving the firing assembly. However, an additional firing head means additional space, weight and cost. Also, when the perforating assembly is discharged by the intended firing head, the backup firing head is necessarily destroyed in the explosion.

There is a need therefore to uniformly perforate the casing to squeeze cement into the intended areas in an efficient and effective time saving manner.

SUMMARY OF THE INVENTION

The present invention provides a method and apparatus for plugging a wellbore in a trip saving manner. In one aspect, the invention includes a cement retainer disposed on a run-in string and a radially expanded perforating assembly disposed below the cement retainer. In a single run, the apparatus provides for perforating a wellbore and squeezing cement through the perforations and into the formation therearound. In another aspect, a method of plugging the wellbore includes running a cement retainer and a radially expanded perforating assembly into a wellbore on a run-in string. After the cement retainer is set, a firing head is actuated to cause the perforating gun to discharge. After perforations are formed, cement is introduced from the cement retainer into the isolated area and squeezed through the perforations. Thereafter, the run-in string disengages from the cement retainer leaving behind the plug formed. In yet another aspect, a firing head capable of being actuated by different means is used to discharge the perforating assembly.

BRIEF DESCRIPTION OF THE DRAWINGS

So that the manner in which the above recited features, advantages, and objects of the present invention are attained and can be understood in detail, a more particular description of the invention, briefly summarized above, may be had by reference to the embodiments thereof which are illustrated in the appending drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
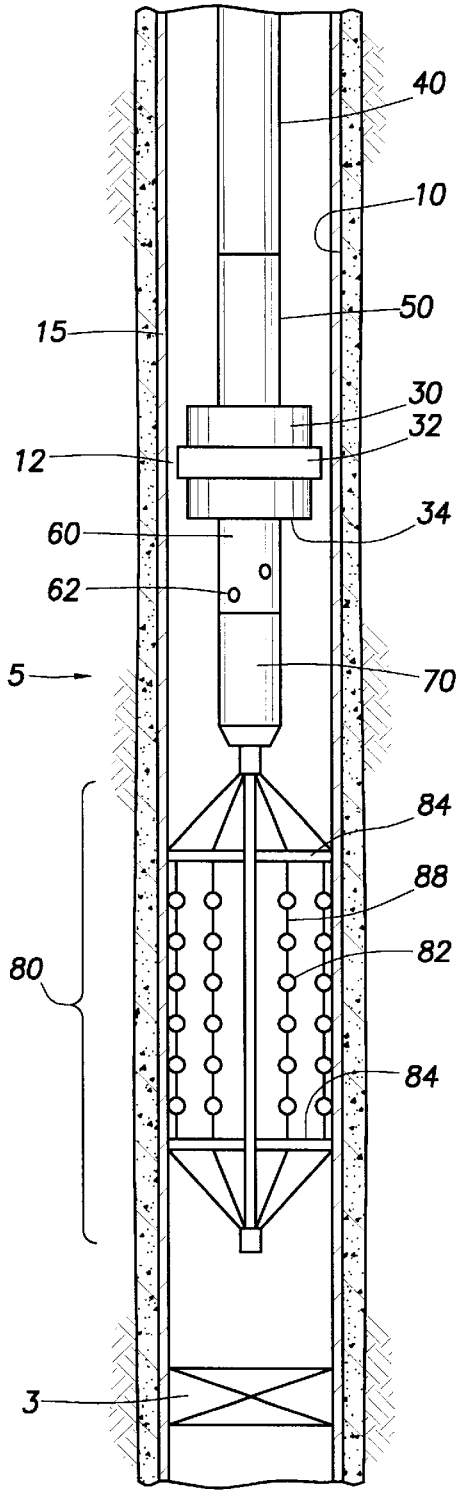
FIG. 1 is a schematic cross-sectional view of an apparatus of the present invention in a run-in position in a wellbore.

FIG. 1 is a schematic view of one embodiment of the plugging apparatus 5 according to the present invention. In FIG. 1, the plugging apparatus 5 is shown in the run-in position and is disposed at the end of a run-in string 40 in a wellbore 10 lined with casing 15. A cement plug or bridge plug 3 is illustrated in the wellbore 10 below the apparatus and is pre-placed in the wellbore 10 prior to the run-in of the apparatus to seal the lower portion of the wellbore 10. A bridge plug 3 is similar to a packer, but without a borehole. The bridge plug 3 is typically anchored using rotational force.

A cement retainer 30 disposed on the run-in string 40 includes a setting tool 50 used to set the cement retainer 30 when the cement retainer 30 reaches a pre-determined depth. The setting tool 50 causes a radially expandable element 32 around the cement retainer 30 to expand to seal an annular space 12 between the cement retainer 30 and the casing 15. The cement retainer 30 is constructed like a packer but includes openings (not shown) located at a lower end 34 for the passage of cement therethrough.

Figure 2:
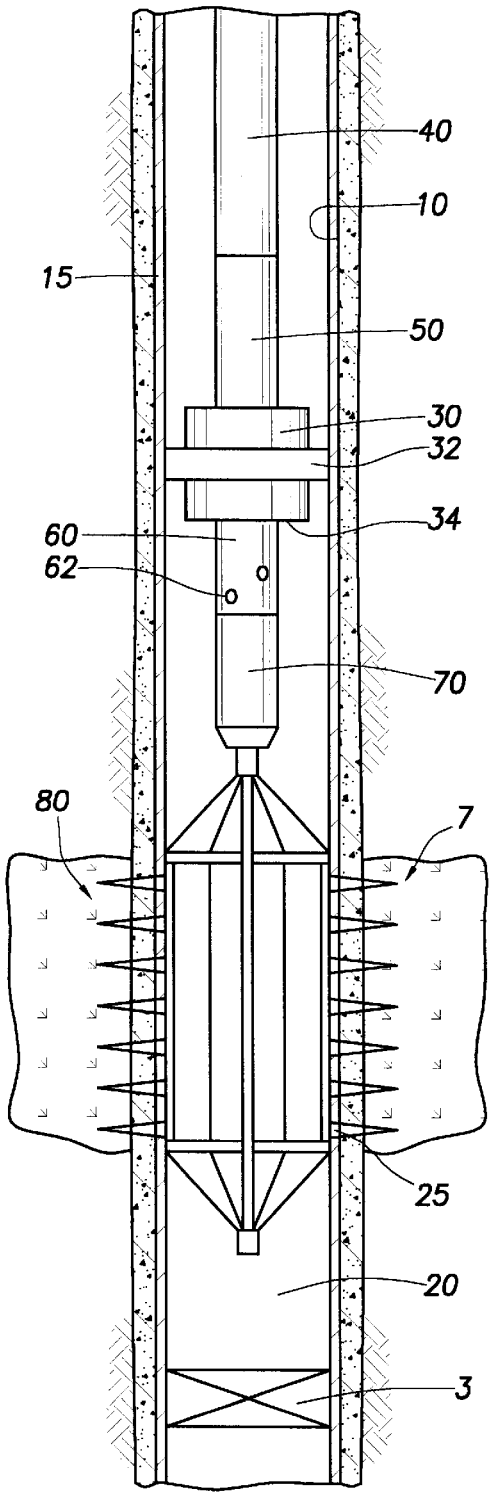
FIG. 2 is a schematic cross-sectional view of the apparatus after a cement retainer is set in the wellbore casing and after perforations have been made.

A ported flow joint 60 connects the cement retainer 30 to a firing head 70 of a perforating assembly 80 disposed therebelow. The ported flow joint 60 is typically 1 ft. in length and preferably about 2 ft. in length. In one embodiment, fluid is supplied to the ported flow joint 60 and exits ports 62 to pressure an isolated area 20 of the wellbore 10 between the bridge plug 3 and the cement retainer 30 as illustrated in FIG. 2. Pressure built up is necessary to actuate the firing head 70. The firing head 70 discharges the perforating assembly 80 when a pre-determined pressure is reached. In another embodiment, the firing head is disposed below the perforating assembly. In yet another embodiment, the firing head can be mechanically actuated to discharge the perforating assembly. In yet another embodiment, a mechanical drop bar firing head is used to trigger the perforating assembly. A mechanical drop bar firing head is actuated by physically dropping a bar into the run-in string to strike the firing pin. In yet another embodiment, more than one firing head is disposed on the run-in string to discharge the perforating assembly. The multiple firing heads can be a combination of the various types of firing heads, including pressure actuated firing heads or mechanically actuated firing heads. In embodiments where a pressure actuated firing head is not used, a non-ported flow joint may be employed.

Figure 7:
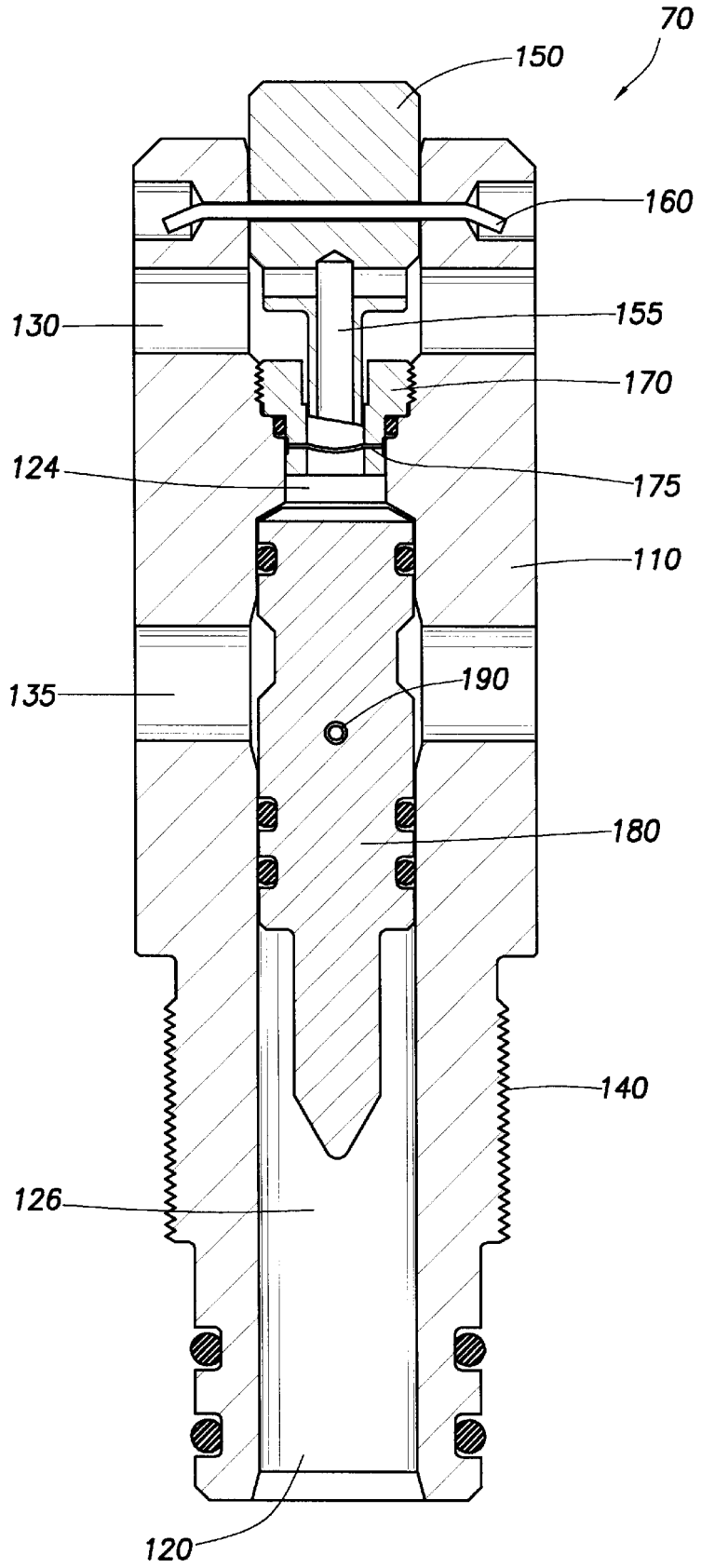
FIG. 7 is a schematic cross-sectional view of a firing head.

Preferably, as shown in FIG. 7, a firing head 70 capable of being actuated by pressure and/or mechanical means is used to discharge the perforating assembly (not shown). The firing head 70 comprises a body 110 with a channel 120 disposed along the length of the body 110. In an upper portion of the body 110, a first set of apertures 130 is formed around the periphery of the body 110 for fluid communication between the wellbore (not shown) and the channel 120. In a middle portion of the body 110, a second set of apertures 135 is formed around the periphery of the body 110 for fluid communication between the wellbore and the channel 120. Preferably, the apertures 130, 135 each include four separate apertures spaced radially at about 90 degrees. The apertures 130, 135 may be the same or different sizes. Threads 140 for attachment to the perforating assembly are formed on an outer surface of a lower portion of the body 110.

Disposed in the upper portion of the channel 120 is a plug 150 held in place by a roll pin 160. The roll pin 160 extends across the width of the plug 150 and into the body 110. The roll pin 160 is preferably made of brass wire and is constructed and arranged to prevent axial movement of the plug within the body. The roll pin 160 is designed to break when a predetermined amount of force is applied thereto. The top of the plug 150 extends above the body 110. The lower portion of the plug 150 has a T-shaped snout 155. The T-shaped snout 155 is hollow for fluid communication with the channel 120 and the first set of holes 130 in the upper portion of the body 110.

Coupled to the snout 155 is a rupture disc assembly 170. The rupture disc assembly 170 sits in the channel 120 just below the first set of holes 130 in the upper portion of the body 110. The snout 155 is partially disposed in a snout channel (not shown) of the rupture disc assembly 170. The snout channel also provides for fluid communication between the snout and a channel area 124 below the rupture disc assembly 170. However, a membrane 175 disposed in the rupture disc assembly 170 blocks the fluid communication between the snout and the channel area below the rupture disc assembly. The membrane 175 is preferably made of steel. The membrane 175 is designed to rupture by pressure or mechanical means.

Disposed below the rupture disc assembly 170 is a firing pin 180. The firing pin 180 may be used to strike a primer cap (not shown) and discharge the perforating assembly. The firing pin 180 is held in place by a retention pin 190 disposed in the second set of holes 135 at the middle portion of the body 110. The firing pin 180 is also maintained in place by the hydrostatic pressure communicated through the second set of holes 135. The retention pin 190 breaks when a predetermined force is exerted against it.

In operation, the firing head 70 is attached to the perforating assembly by the threads 140 on the outer portion of the body 110 and is lowered into the wellbore. Referring again to FIG. 7, the pressure in channel areas above 124 and below 126 the firing pin 180 is at atmospheric pressure prior to actuation. The first and second set of holes 130, 135 of the body 110 are at hydrostatic pressure. To mechanically actuate the firing head 70, a drop bar (not shown) is dropped from the surface into the wellbore to strike the top of the plug 150. On its way down, the drop bar acquires sufficient energy to strike the top of the plug 150 and cause the roll pin 160 to break. Once released, the plug 150 slides down and the snout 155 coupled to the rupture disc assembly 170 strikes and breaks the membrane 175.

Figure 8:
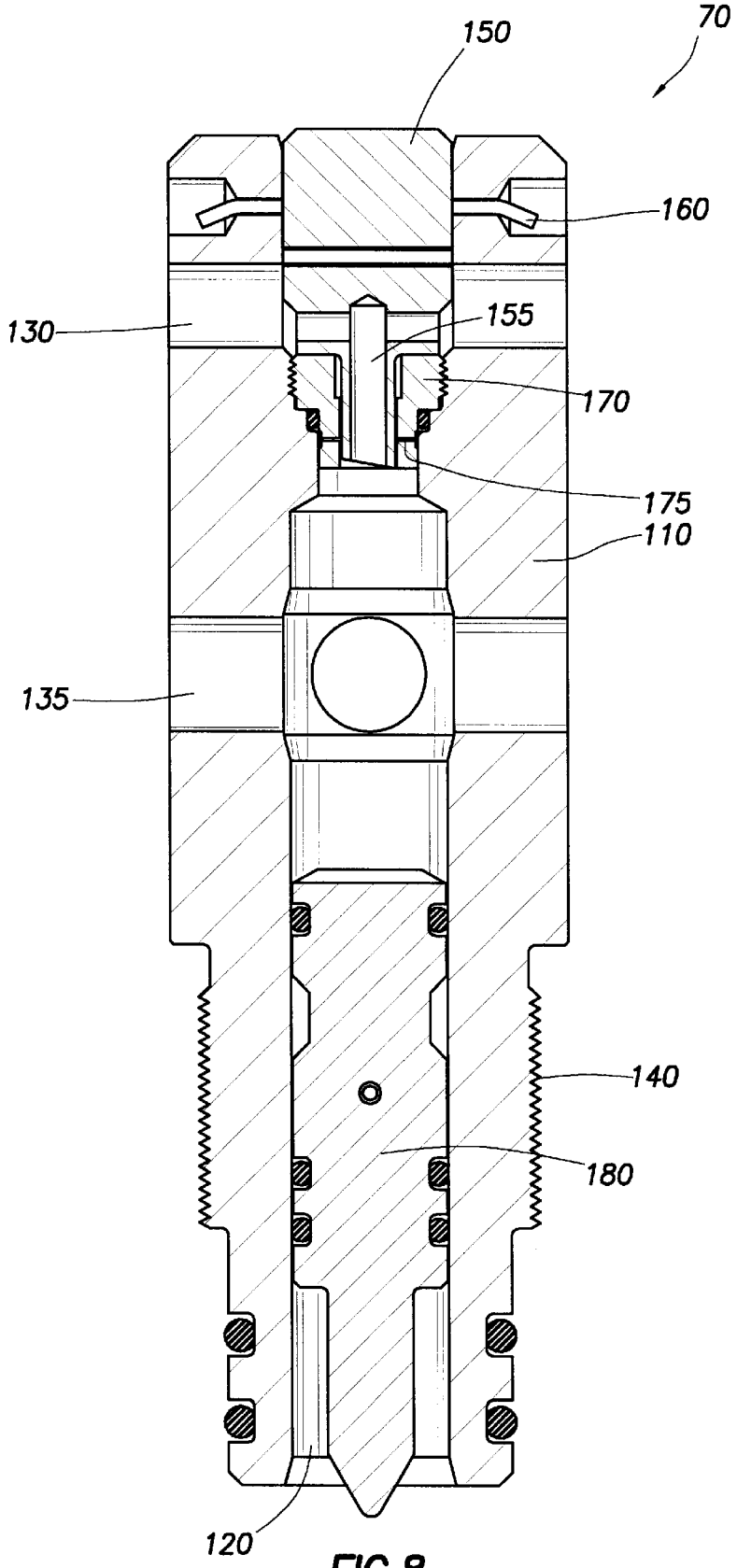
FIG. 8 is a schematic cross-sectional view of a firing head after being mechanically actuated.

After the membrane 175 breaks, the channel area above 124 the firing pin 180 can fluidly communicate with the hollow T-shaped snout 155 and the first set of holes 130 in the upper portion of the body 110. Thus, the pressure in the channel above the firing pin 180 increases from atmospheric to the hydrostatic pressure in the casing. The increase in pressure creates a pressure differential between the area above 124 the firing pin 180 and area below 126 the firing pin 180. The hydrostatic pressure above the firing pin 180 puts downward pressure on the firing pin 180 which causes the retention pin 190 to break and forces the firing pin 180 to slide down in the channel 120. The firing pin 180 strikes the primer cap (not shown) of the perforating assembly with a downward force and discharges the perforating assembly. FIG. 8 illustrates the firing head 70 after being mechanically actuated.

Figure 9:
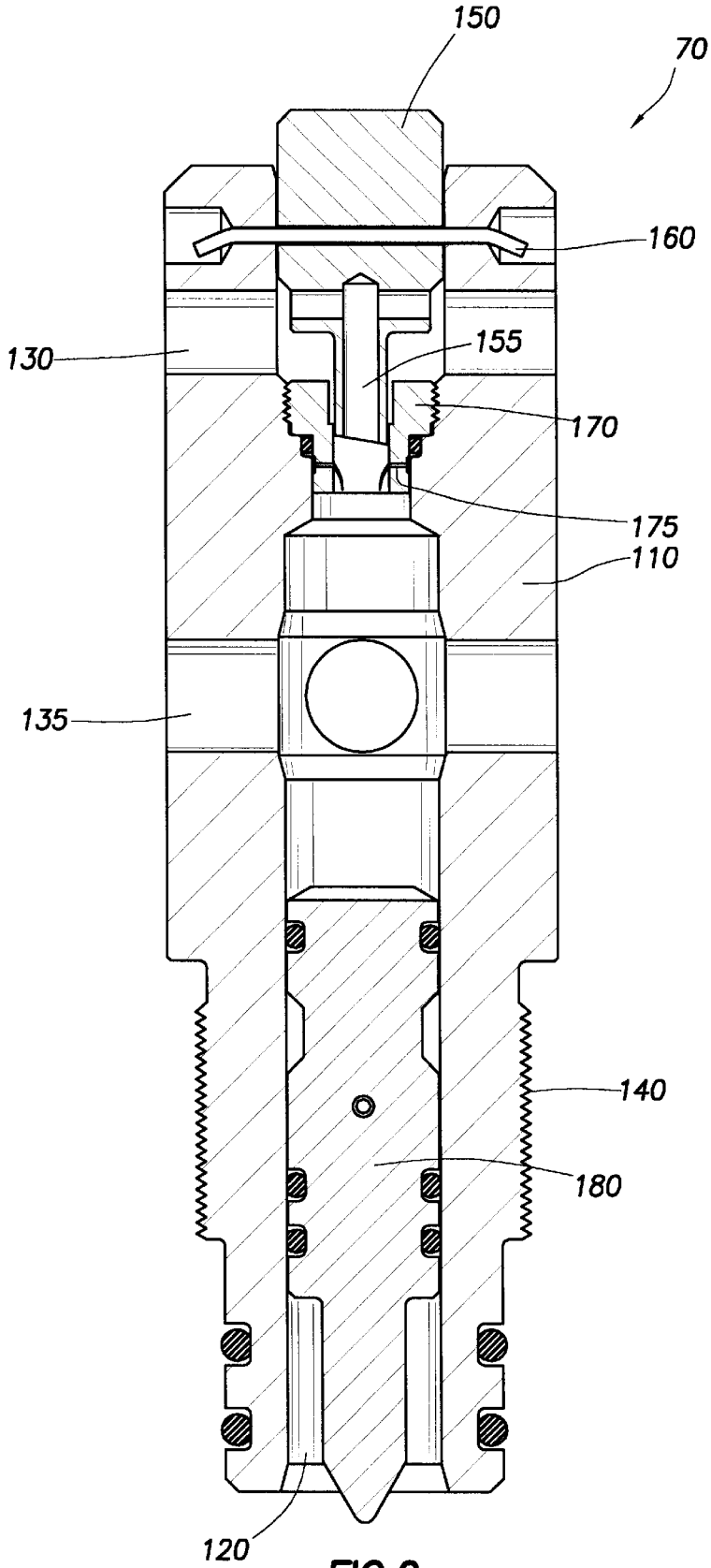
FIG. 9 is a schematic cross-sectional view of a firing head after being actuated by pressure.

The firing head 70 shown in FIG. 7 can also be actuated with hydrostatic pressure. In operation, the hydrostatic pressure in the casing is increased to exert a force against the membrane 175 through the hollow snout 155. Once a predetermined pressure is reached, the membrane 175 breaks. Similar to mechanical actuation, the rupture of membrane 175 allows the channel area above 124 the firing pin 180 to increase from atmospheric pressure to the hydrostatic pressure. The increase in pressure causes the retention pin 190 to break and forces the firing pin 180 to move down the channel 120 and discharge the perforating assembly. FIG. 9 illustrates the firing head 70 after being actuated by pressure.

The firing head described is particularly advantageous for use with the present invention. Once the cement retainer is set, it would be very difficult to retrieve and replace the firing head if the firing head does not actuate. More importantly, retrieving the firing head would reduce the overall efficiency of the present method of plugging a wellbore. The use of a firing head with more than one actuation means will eliminate the need for a backup firing head and the cost associated with it.

Although the firing head is described in use with the present invention, its use is not limited to the present invention. The firing head may also be used with conventional perforating assemblies. In addition to perforating charges, the firing head may alternatively be used to ignite other types of charges. For example, the firing head may be used in a string shot to facilitate the separation of two drill pipes. Typically, a firing head attached to a charge assembly is lowered into a wellbore to an area proximate a thread connecting two drill pipes. A torque is applied on the drill pipes to separate the pipes. While under torque, the firing head is actuated to ignite the charge assembly. The explosion exerts a force on the thread and assists the torque in separating the pipes. The firing head may also be used to ignite a charge in a junk shot. Junk shots are typically used to clear obstacles in a wellbore. The firing head may also be attached to a coupling separator. The firing head ignites charges in the coupling separator. The explosion expands a coupling connecting two tubings and aids the separation of the tubings. The embodiments of the firing head disclosed herein are not exhaustive. Other and further embodiments of the firing head may be devised by a person of ordinary skill in the art from the basic scope herein.

Referring again to FIG. 1, the perforating assembly 80 is an expandable assembly that can be adjusted to bias against the casing 15. In operation, the perforating assembly 80 is expanded so that it is biased against the casing 15 as it is being lowered into the wellbore 10. The perforating assembly 80 includes wear plates (not shown) that slide along the inner diameter of the casing 15. The force of the perforating discharge can be controlled by varying the distance between the explosive charges 82 and the casing 15. Because the perforating assembly 80 is biased against the casing 15, the distance between the explosive charge and the casing 15 can be pre-determined and set prior to the entry into the wellbore 10. Additionally, the perforating assembly 80 has circulating charges 82 that can uniformly perforate the casing 15. For example, in the embodiment shown in FIG. 1, the perforating assembly 80 has six strings 88 of charges 82 separated by about 60° placed about the periphery of two disks 84 that are separated by about 1 ft. Each string 88 of explosive charges 82 has a density of up to six charges 82 mounted between the disks 84. Thus, each perforating assembly 80 may hold 36 explosive charges 82. Alternately, four strings 88 of explosive charges 82 may be spaced at 90° to hold a total of twenty-four (24) explosive charges 82. In addition, the number of explosive charges may be increased by mounting two 1 ft. stacks of explosive charges 82 above each other.

In operation, a bridge plug 3 or, alternatively, a cement plug is installed in the wellbore 10 below the intended area of perforations 25 of the casing 15 as illustrated in FIG. 1. Thereafter, the plugging apparatus 5 attached to a run-in string 40 is lowered into the wellbore 10. When the plugging apparatus 5 reaches a pre-determined depth, the cement retainer 30 disposed on the plugging apparatus 5 is set against the casing 15 as illustrated in FIG. 2. A setting tool 50 connected to the cement retainer 30 is rotated to set the cement retainer 30. Rotating the setting tool 50 causes a radially expandable element 32 around the cement retainer 30 to expand and seal off the annular space 12 between the cement retainer 30 and the casing 15 as illustrated in FIGS. 1 and 2. When set, the cement retainer 30 acts as a packer and isolates area 20 in the casing 15 between the cement retainer 30 and the bridge plug 3.

In the embodiment shown in FIG. 2, after the cement retainer 30 is set, fluid is pumped in to pressurized the isolated area 20. Fluid is typically pumped through the run-in string 40, the cement retainer 30, the ported flow joint 60 connected to the cement retainer 30, and the ports 62 in the ported flow joint 60 and exits into the isolated area 20. The ported flow joint 60 is at least about 1 ft. in length, preferably about 2 ft. in length. When a pre-determined pressure is reached, the firing head 70 is actuated and causes the perforating assembly 80 to discharge and perforate the casing 15. Once the casing 15 is perforated, the isolated area 20 will be in fluid communication with the formation 7.

In another embodiment, after the cement retainer 30 is set, a bar is physically dropped from the surface through the run-in string 40 to strike a firing pin of a firing head in the perforating assembly 80. The mechanically actuated firing head causes the perforating assembly 80 to discharge and perforate the casing 15. In yet another embodiment, more than one firing head is disposed on the run-in string. The multiple firing heads may be a combination of a variety of firing heads, including a pressure actuated firing head, a mechanically actuated firing head, or other types of firing head. FIG. 2 illustrates the apparatus after the perforations 25 have been made.

Figure 3:
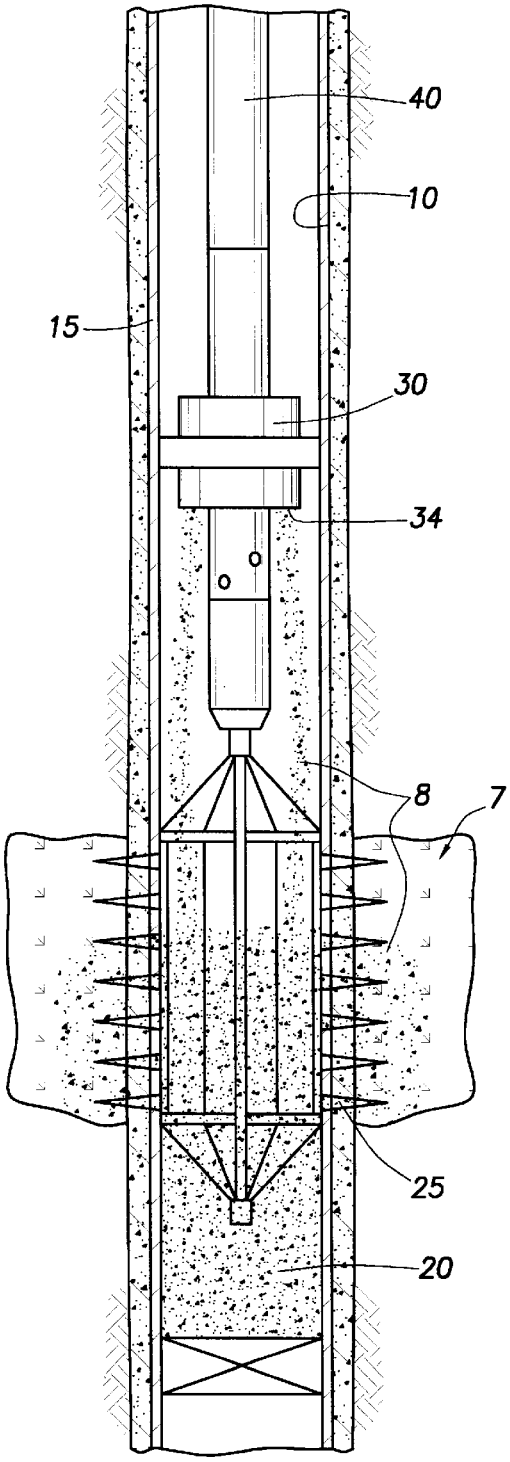
FIG. 3 is a schematic cross-sectional view of the apparatus after perforations are formed in the casing wall and cement has been squeezed through the perforations and into the casing.

After the perforations 25 are made, cement 8 is pumped from the surface down through the run-in string 40 and exits openings 34 in the cement retainer 30 as illustrated in FIG. 3. As the cement 8 is pumped into the isolated area 20, the increase in pressure squeezes the cement 8 through the perforations 25 and into the formation 7. Cement 8 is squeezed until the desired amount of cement 8 is disposed in the formation 7 and the isolated area 20 in the casing 15 is filled. In this manner, any fluid path along the outside of the wellbore 10 is sealed to the upward flow of fluid.

Figure 4:
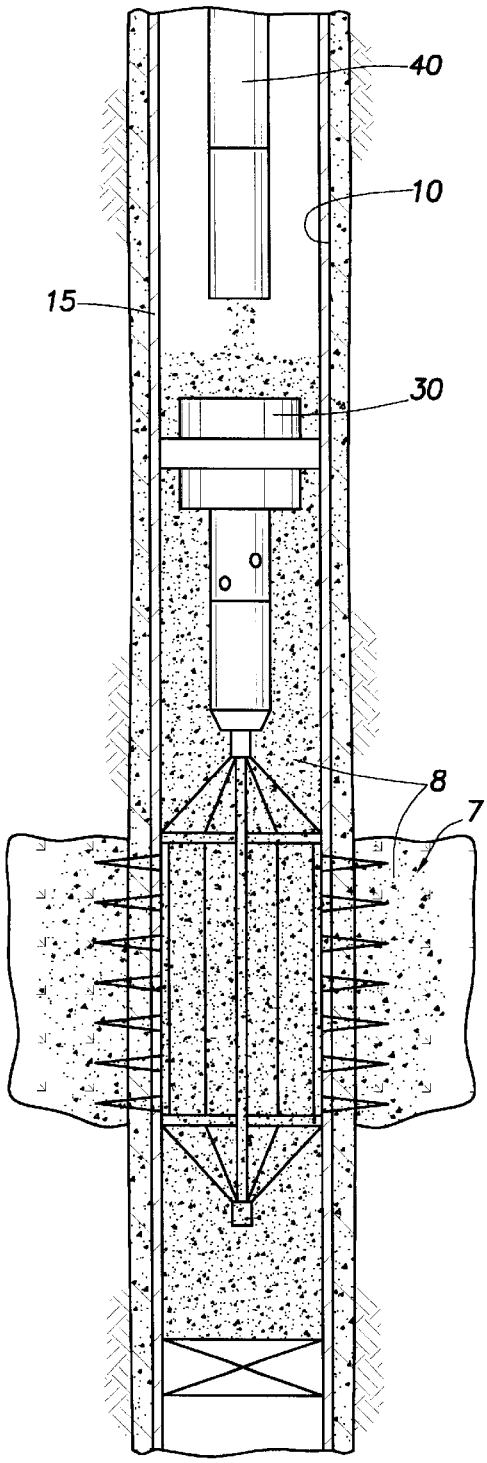
FIG. 4 is a schematic cross-sectional view of the apparatus after the cementing job is complete and a run-in string is disengaged from the cement retainer.

Once filled with cement 8, the run-in string 40 is disengaged from the cement retainer 30 as illustrated in FIG. 4. Thereafter, more cement 8 is typically deposited on top of the cement retainer 30. Unlike the conventional plugging process, the present invention requires only a single run to perforate the casing 15, squeeze cement 8, and plug and abandon the wellbore 10.

Figure 5:
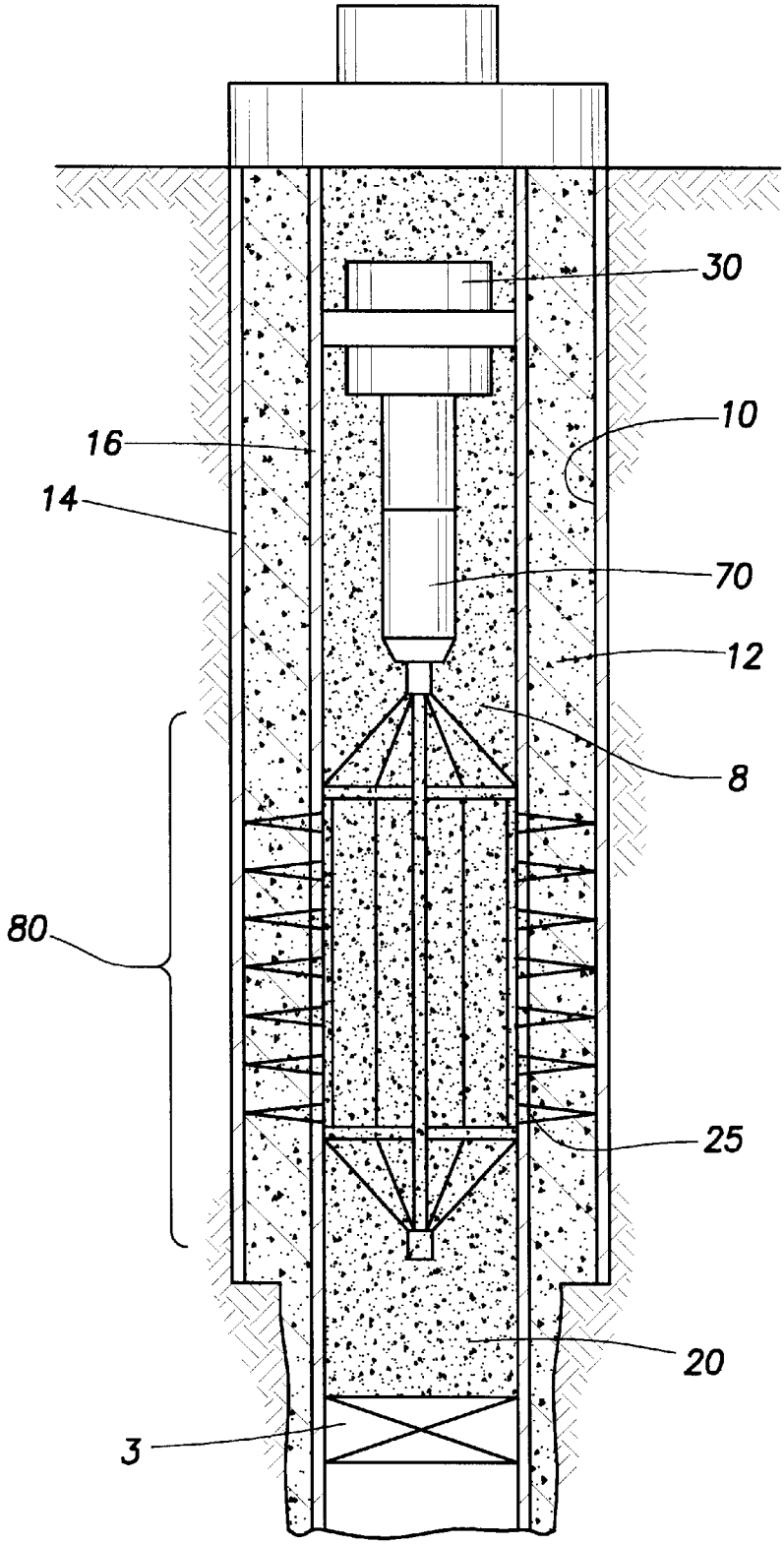
FIG. 5 is a cross-sectional view of a plug formed in a wellbore containing concentric strings of casing.

In another embodiment as illustrated in FIG. 5, the plugging operation of the present invention may be used to squeeze cement 8 to fill an annular space 12 formed by two coaxially disposed strings of tubular. After a bridge plug 3 is set, a cement retainer 30 attached to a run-in string (not shown) is set above the bridge plug 3. An isolated area 20 is thereafter pressurized to actuate the firing head 70 and cause the perforating assembly 80 to discharge and form perforations 25. However, in this embodiment, only the inner tubular 16 is perforated and damage to the outer tubular 14 is minimized. The expandable perforating gun 80 is particularly advantageous in this application because the depth of the perforations can be controlled as described above. After the perforations are formed, cement 8 is introduced into the isolated area 20 through the cement retainer 30 where it travels through the perforations 25 and into the annular space 12. After the annular space 12 and the isolated area 20 are filled, the run-in string 40 is disengaged from the cement retainer 30. Thereafter, cement 8 is poured on top of the cement retainer 30. Additionally, the inner string 16 above the cement plug formed may be cut and removed from the wellbore 10.

Figure 6:
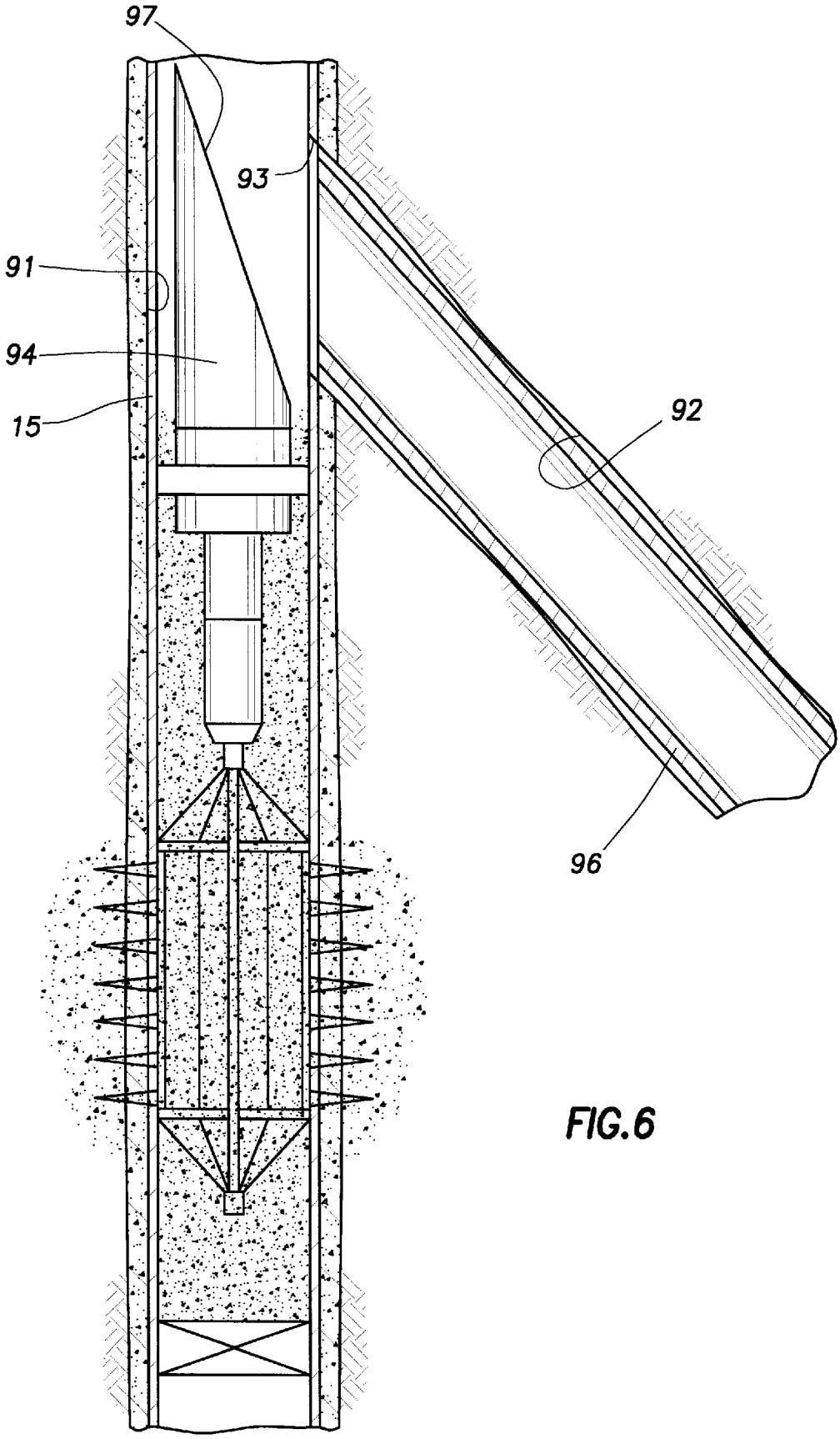
FIG. 6 is a cross-sectional view of a plug formed in a central wellbore with a lateral wellbore formed thereabove.

In yet another embodiment as illustrated by FIG. 6, the plugging operation of the present invention may be performed in wells prior to the formation of an adjacent lateral wellbore 92. Thereafter, a cement plug formed in the central wellbore 91 may be used as a platform to drill the lateral wellbore 92. After the cement plug is formed, a whipstock 94 or some other divertor is anchored in place. Thereafter, a rotating mill disposed on drill string (not shown) travels along a concave face 97 of the whipstock 94 to form a window 93 in the casing 15. A conventional drill bit is then used to form a borehole, which can subsequently be lined with a tubular 96.

As described and illustrated, the present invention provides methods and apparatus to effectively and efficiently plug a wellbore to ensure fluid does not migrate to the surface of the well along the interior and exterior of the wellbore.

While the foregoing is directed to the preferred embodiment of the present invention, other and further embodiments of the invention may be devised without departing from the basic scope thereof, and the scope thereof is determined by the claims that follow.

What is claimed is:

1. An apparatus for use in plugging a wellbore, comprising:

a cement retainer for disposal on a run-in string of tubular; and at least one radially expandable perforating assembly disposed below the cement retainer.

2. The apparatus of claim 1, further comprising at least one firing head disposed on the run-in string of tubular.

3. The apparatus of claim 2, wherein the at least one firing head is pressure actuated.

4. The apparatus of claim 2, wherein the at least one firing head is mechanically actuated.

5. The apparatus of claim 1, further comprising a ported flow joint disposed on the run-in string of tubular.

6. The apparatus of claim 5, wherein the ported flow joint is at least about 1 ft. in length.

7. The apparatus of claim 1, further comprising a setting tool disposed above the cement retainer.

8. The apparatus of claim 7, wherein the setting tool may be rotated.

9. The apparatus of claim 1, wherein the cement retainer further comprises a radially expandable element.

10. The apparatus of claim 1, wherein the cement retainer further comprises at least one opening for fluid communication.

11. The apparatus of claim 1, wherein the perforating assembly is an expandable assembly that can be adjusted to bias against an inner diameter of a casing wall.

12. The apparatus of claim 1, wherein the perforating assembly comprises at least one explosive charge within a casing.

13. The apparatus of claim 12, wherein the distance between the at least one explosive charge and the casing is determined prior to entry into the wellbore.

14. The apparatus of claim 1, wherein the perforating assembly comprises at least one member which slides along an inner diameter a casing wall with at least one explosive charge therein.

15. A method of plugging a wellbore, comprising:

running an apparatus into the wellbore on a tubular string, the apparatus including:

a cement retainer disposed on the tubular string; and a radially expandable perforating assembly disposed below the cement retainer;

setting the cement retainer to seal an annular area between the cement retainer and a casing wall therebetween;

causing the perforating assembly to discharge and forming perforations in the casing wall; and injecting cement through the tubular string and into a formation adjacent the perforations.

16. The method of claim 15, further comprising:

applying a pre-determined pressure to an isolated area of the wellbore below the cement retainer to cause the perforating assembly to discharge.

17. The method of claim 16, further comprising:

removing the tubular string from the apparatus;

placing a plug of cement on top of the cement retainer.

18. The method of claim 17, further comprising disposing a whipstock above the plug.

19. The method of claim 15, wherein the perforations are formed on an inner tubular and the cement is injected through the perforations and into an annular area between the inner tubular and an outer tubular.

20. The method of claim 15, further comprising setting a bridge plug in the wellbore prior to running the apparatus into the wellbore.

21. The method of claim 15, wherein setting the cement retainer comprises:

rotating a setting tool connected to the cement retainer; and causing a radially expandable element around the cement retainer to expand.

22. An apparatus for use in plugging a wellbore, comprising:

means for lowering a cement retainer and at least one radially expandable perforating assembly into the wellbore;

means for setting the cement retainer against a casing; and means for discharging the perforating assembly.

23. The apparatus of claim 22, wherein the means for discharging the perforating assembly comprises at least one firing head.

24. The apparatus of claim 22, further comprising means for injecting cement through at least one perforation.

25. A method of plugging a wellbore, comprising:

placing an apparatus on a tubular string, the apparatus comprising:

a cement retainer; and a radially expandable perforating assembly disposed below the cement retainer;

setting a standoff distance from the perforating assembly to a casing wall therearound;

running the apparatus into the wellbore on the tubular string; setting the cement retainer to seal an annular area between the cement retainer and the casing wall;

causing the perforating assembly to discharge, thereby forming perforations in the casing wall; and injecting cement through the tubular string and into a formation adjacent to the perforations.

26. An apparatus for use in plugging a wellbore, comprising:

means for setting a parameter under which at least one radially expanded perforating assembly discharges within a wellbore;

means for lowering a cement retainer and the perforating assembly into the wellbore;

means for setting the cement retainer against a casing; and means for discharging the perforating assembly.

27. The apparatus of claim 26, further comprising means for setting the perforating assembly against the casing while lowering the cement retainer and the perforating assembly into the wellbore.

* * * * *